US006701676B1

(12) United States Patent
Kompelien

(10) Patent No.: US 6,701,676 B1
(45) Date of Patent: Mar. 9, 2004

(54) ATTIC ACCESS APPARATUS

(76) Inventor: Chad M. Kompelien, P.O. Box 369, Willmar, MN (US) 55620

( * ) Notice: Subject to any disclaimer, the term of this patent is extended or adjusted under 35 U.S.C. 154(b) by 0 days.

(21) Appl. No.: 09/876,328

(22) Filed: Jun. 7, 2001

Related U.S. Application Data

(60) Provisional application No. 60/209,954, filed on Jun. 8, 2000.

(51) Int. Cl.[7] ..... E02D 29/14; E04B 7/18; E04D 13/00; E04F 19/08

(52) U.S. Cl. ..... 52/19; 52/186; 52/199; 52/20; 52/39; 52/407.2

(58) Field of Search ..... 52/19, 72, 186, 52/202, 404.4, 198, 199, 195, 20, 203, 404.1, 407.2, 407.3, 39; 49/463; 182/46, 77; 411/511; 24/580.1

(56) References Cited

U.S. PATENT DOCUMENTS

| | | | | | |
|---|---|---|---|---|---|
| 4,151,894 | A | | 5/1979 | Edwards | |
| 4,299,059 | A | | 11/1981 | Smith | |
| 4,312,423 | A | | 1/1982 | Helbig | |
| 4,658,555 | A | * | 4/1987 | Steiner | 182/77 |
| 4,928,441 | A | * | 5/1990 | Daley | 182/77 |
| 5,050,706 | A | | 9/1991 | Cole et al. | |
| 5,274,966 | A | * | 1/1994 | Daley | 52/23 |
| 5,475,955 | A | * | 12/1995 | Dickinson | 182/46 |
| 5,481,833 | A | * | 1/1996 | Williams | 160/180 |
| 5,623,795 | A | * | 4/1997 | Padgett, Jr. | 182/47 |
| 5,628,151 | A | | 5/1997 | Monat | |
| 5,735,086 | A | * | 4/1998 | Fordahl | 454/195 |
| 6,260,305 | B1 | * | 7/2001 | Joyce | 49/489.1 |
| 6,341,450 | B1 | * | 1/2002 | Macander et al. | 114/117 |

FOREIGN PATENT DOCUMENTS

| | | | | |
|---|---|---|---|---|
| CH | 619037 | * | 12/1978 | F24D/19/00 |
| JP | 6-200582 | * | 7/1994 | E04B/7/18 |

* cited by examiner

*Primary Examiner*—Carl D. Friedman
*Assistant Examiner*—Chi Q. Nguyen

(57) ABSTRACT

An attic access apparatus has a housing with a passage open to the attic and a door located in the passage for closing the passage. Insulating material in the passage above the door limits heat loss and air flow through the passage.

30 Claims, 4 Drawing Sheets

ATTIC ACCESS APPARATUS

CROSS REFERENCE TO RELATED APPLICATION

This application claims the priority benefit of U.S. Provisional Application Serial No. 60/209,954 filed Jun. 8, 2000.

The invention relates to closures for openings in ceilings to provide access to attics and spaces above the ceilings. The closures are removable doors used to close openings in ceilings of buildings.

BACKGROUND OF THE INVENTION

The ceilings of homes have openings to provide admittance to attics and spaces above the ceilings. Frameworks secured to the ceiling and ceiling rafters have inwardly directed shoulders for supporting panels, such as plywood sheet, used to close the ceiling openings. Insulation materials, such as glass fiber mats, are located in the attic to insulate the ceilings. The panels closing the openings in some ceilings are not covered with insulation. Mats of insulation material are placed on top of the panels to increase the thermal efficiency of the panels. When the panels are lifted or opened the insulation mats move up in the attic and laterally of the openings in the ceilings. The openings are closed by placing the panels on the shoulders of the framework. There is no assurance that the mats of insulation will fall back into place on top of the panels. Thermal efficiency of the ceiling is compromised by allowing warm air to flow around the panels up into the attic and hot attic air to flow into the rooms below the ceilings.

Examples of attic opening covers and covers for stairwells are illustrated in the following U.S. Patents.

R. A. Edwards in U.S. Pat. No. 4,151,894 discloses an insulating cover for a retractable or folding stairs. The cover is a box structure having a size to fit over an opening in an upper floor. A pair of wheels on one end of the cover allows the cover to be moved to open the opening in the floor. A rubber gasket fixed on the lower edge of the cover is in sealing engagement with the floor.

W. V. Smith in U.S. Pat. No. 4,299,059 discloses an insulated and fire resistant ceiling mounted attic door hinged to a frame surrounding an opening in the ceiling. The door has a peripheral frame attached to a flat plaster panel. A layer of insulation material on top of the panel is located within the frame. Cross braces secured to the frame supports a foldable stair.

E. G. Helbig in U.S. Pat. No. 4,312,423 discloses a removable thermal barrier cover for a stairwell opening normally closed with a panel supporting a three piece ladder. The cover is a plastic box structure used in the shipping carton for the ladder unit.

A. N. Monat in U.S. Pat. No. 5,628,151 discloses a box type insulation cover locatable over a framed attic opening in a ceiling. The cover is a multipocket member holding insulation for preventing heat loss through the attic opening.

SUMMARY OF THE INVENTION

The invention is an attic apparatus that closes an attic access opening without loss of thermal efficiency. A door and associated insulation is used to self seal the ceiling opening and insure proper location of the insulation above the door. The door has an airtight seal with a sealing member mounted on a housing to prevent air from flowing between the door and housing into and out of the space below the ceiling.

The apparatus has a rectangular housing secured to ceiling rafters. The housing has upright walls that extend upwardly into the attic or space above the ceiling. The walls surround a passage open to the attic. A door, sheet rock, and insulation material located in the passage close the passage. The sheet rock and insulation material hold the door in a sealing relationship with a rectangular seal supported on the housing. When the door is closed the insulation material is in the passage thereby providing maximum thermal efficiency.

The attic access apparatus is easy to install and can be used in new construction, remodeling and retrofitting buildings. The housing is inserted into a cut hole in the ceiling between ceiling rafters. Screws are used to secure the housing to the rafters. The insulation, sheet rock board and door are placed in the passage to close the passage airtight. Taping flanges on the housing are nailed to the ceiling and covered with texture or trim to complete the installation of the attic access apparatus.

The object and advantage of the attic access apparatus of the invention are embodied in the structure shown in the drawings and described in the following description of the invention.

DESCRIPTION OF THE INVENTION

Figure 1:
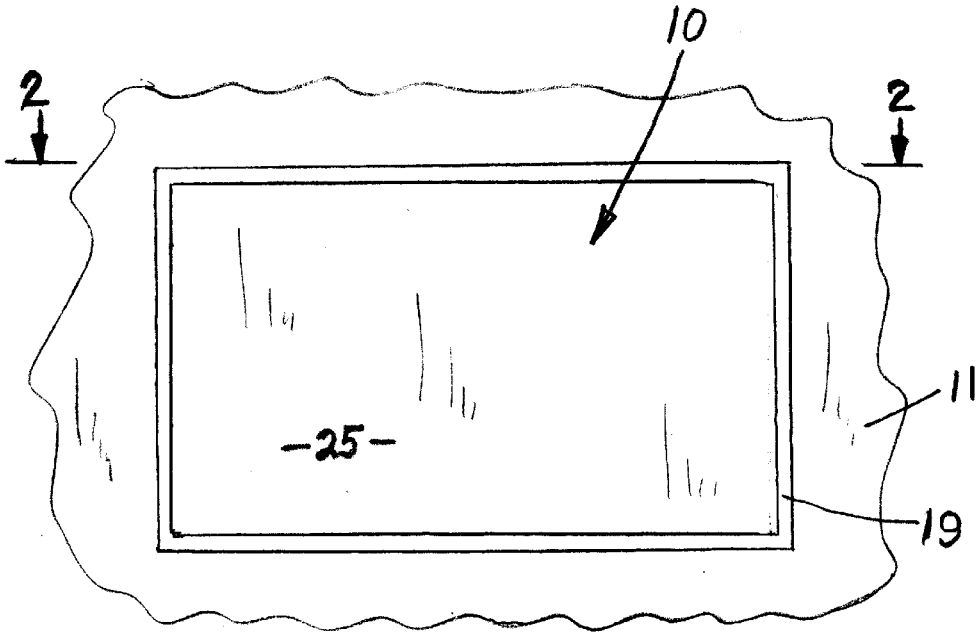
FIG. 1 is a bottom plan view of the attic access apparatus of the invention mounted on a ceiling of a structure below the attic of the structure.
Figure 2:
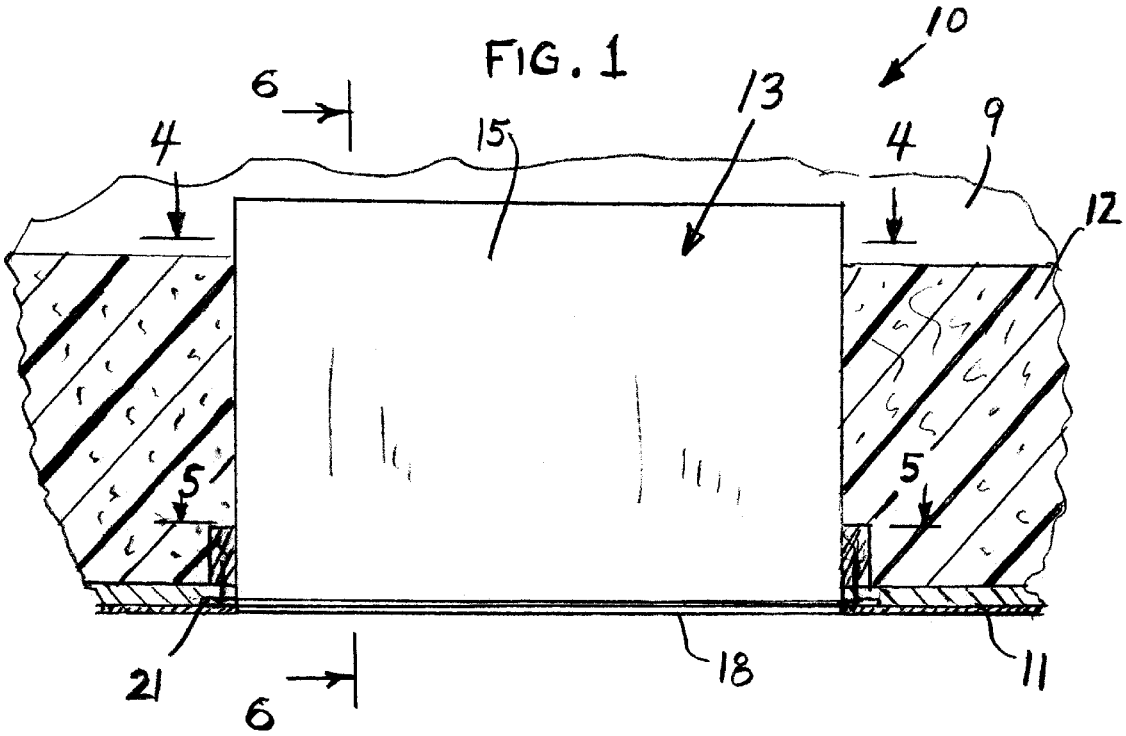
FIG. 2 is a sectional view taken along line 2—2 of FIG. 1.
Figure 3:
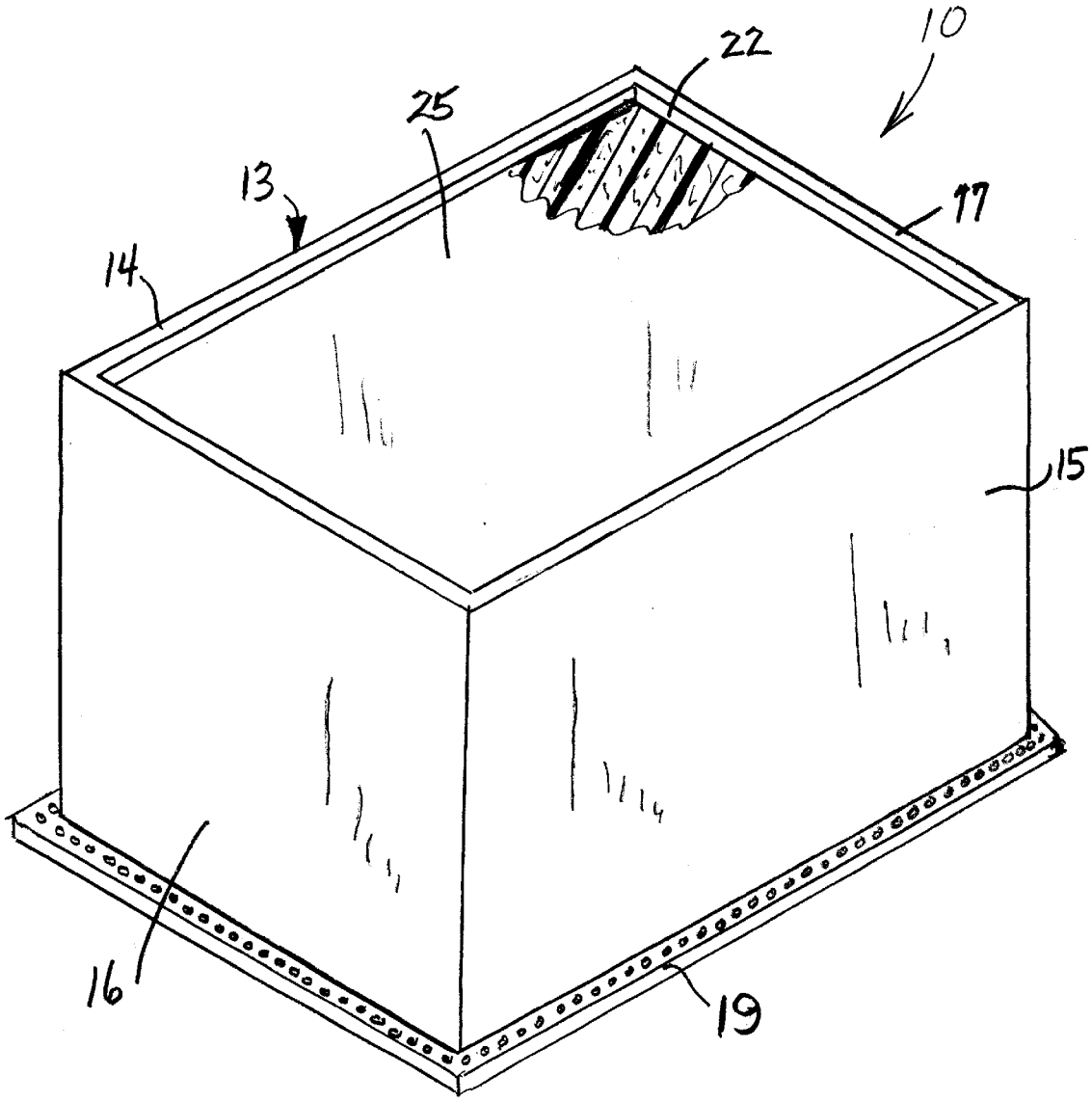
FIG. 3 is a perspective view of the attic access apparatus of FIG. 1.

The attic access apparatus 10 of the invention, shown in FIGS. 1 and 2, mounted on a ceiling of a building, such as a home or commercial structure, provide an opening for admittance to an attic or space 9 above the ceiling 11. One or more layers of insulation 12, such as glass fiver mats, are located on top of ceiling 11 to provide a heat barrier which reduces heat loss through ceiling 11. Other types of insulation materials can be used above ceiling 11.

Attic access apparatus 10 has a rectangular housing 13 comprising flat upright side walls 14 and 15 joined to upright end walls 16 and 17. Walls 14–17 are joined to bottom members 18 having a rectangular horizontal surface 19. Surface 19 is co-extensive with the outer surface of ceiling 10. An outwardly di joined to bottom members 18. Flange 21 extending around walls 14–17 have holes to retain plaster and accommodates fasteners that attach apparatus 10 to ceiling supports. Walls 14–17 and bottom members 18 can be metal, wood, plywood and like sheet material.

Figure 6:
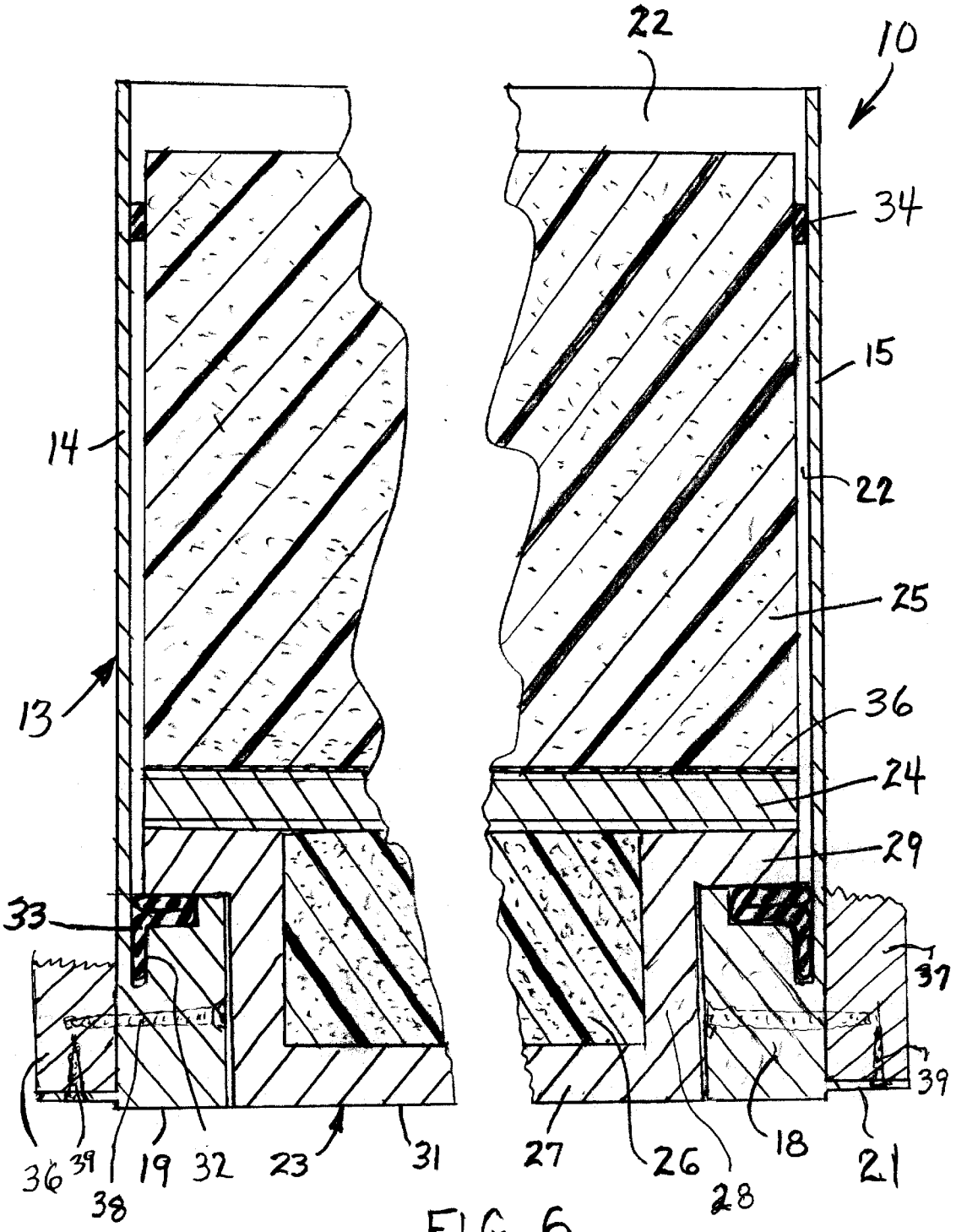
FIG. 6 is an enlarged foreshortened sectional view taken along line 6—6 of FIG. 2.

As shown in FIG. 6, housing 13 has a passage 22 open to the attic and space below ceiling 11. Passage 22 provides access and admittance to the attic or space above ceiling 11. Passage 22 is normally closed with a door 23, sheet rock or gypsum panel 24, and insulation members 25 and 26 to reduce heat loss through passage 22. Panel 24 is used for fire protection. Door 23 has a flat bottom wall 27 joined to upright side walls 28. The bottom surface 31 of wall 27 is flat and co-extensive with the flat surface 19 of bottom members 18. An outwardly directed horizontal flange or lip 29 joined to the top of walls 28 rests on top of bottom members 18 to support door 23 on bottom members 18 inside passage 22 thereby closing the lower end of passage 22. The space between the bottom wall 27 and panel 24 is filled with an insulation member 26, such as a foamed plastic or glass fiber mat or polyurethane sheets. Insulation member 25 resting on member 24 is a foamed plastic. Other insulation materials can be used for insulation members 25 and 26. An adhesive 36 secures insulation member 25 to panel 24. Insulation member 25 is a one-piece block of foamed plastic located in passage 22. Member 25 extends upwardly from panel 24 and substantially fills passage 22 above panel 24. The side walls of member 25 are located in spaced close relation to the inside of walls 14 and 15 of housing 13.

Figure 5:
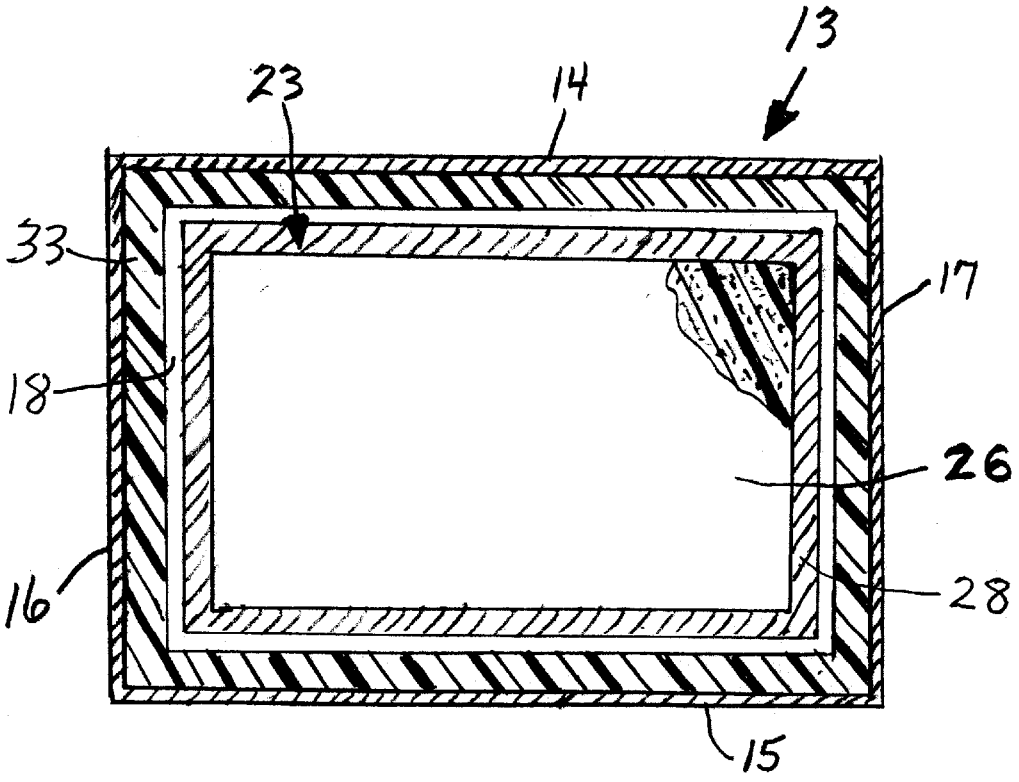
FIG. 5 is a sectional view taken along line 5—5 of FIG. 2.

As shown in FIGS. 2, 5 and 6, the top portions or shoulder of bottom members 18 has a right angle groove 32 with an open top. Groove 32 extends around bottom members 18 and has an inwardly directed horizontal portion and a vertical portion. A right angle seal 33 fits in groove 32. Seal 33 is a one-piece flexible rubber or plastic band the engages the bottom of flange 29 to inhibit or prevent air from flowing between door 23 and bottom members 18. Seal 33 has a vertical section located in the vertical portion of groove 32 and a folded horizontal section located in the horizontal portion of groove 32. The sheet rock panel 24 is a flat board that rests on top of flange 29. The weight of panel 24 and insulation material 25 holds door closed and flange 29 in self sealing relation with seal 33.

Figure 4:
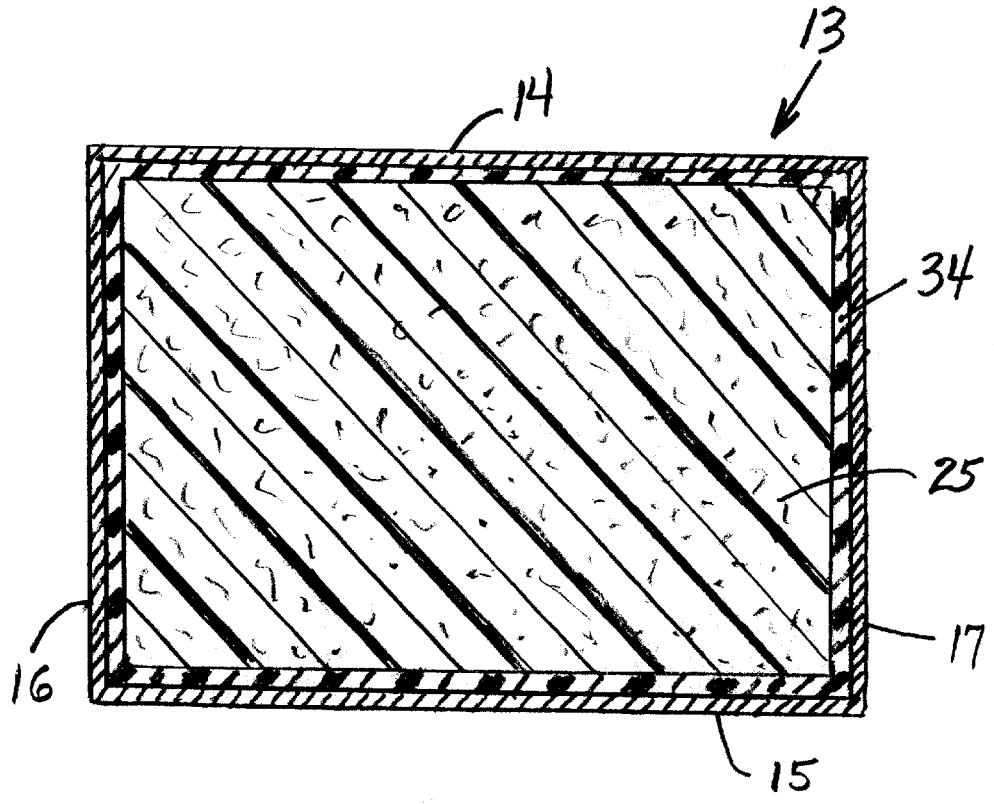
FIG. 4 is a sectional view taken along line 4—4 of FIG. 2.

As shown in FIGS. 4 and 6, a rectangular gasket 34 secured to the inside walls 14–17 surrounds insulation member 25. Gasket 34 is a flexible member located in engagement with insulation member 25 to close the space between walls 14–17 and insulation member 25 and inhibit the flow of air in passage 22. Gasket 34 can have flexible ribs to allow insulation member 25, members 24 and door 23 to be moved upwardly through passage 22 to open passage 22 thereby providing access to the attic.

As shown in FIG. 6, attic access apparatus 10 is installed into a precut hole in ceiling 11 between the ceiling rafters 36 and 37. Screws 38 or other fasteners secure housing 13 to the rafters or spacing lumbers attached to the rafters. The location of housing 13 is checked, squared, and leveled if necessary. Taping flange 21 is then nailed to rafters 36 and 37 and the ceiling with nails 39 and covered with taping compound, texture or trim.

While there has been shown and described an embodiment of the invention, it is understood that changes in structures, materials and arrangement of structures can be made by one skilled in the art without departing from the invention.

What is claimed is:

1. An apparatus for providing a closure for a ceiling opening to a space above the ceiling comprising: a housing having upright walls adapted to fit in an opening in a ceiling and extended upwardly into the space located above the ceiling, said walls surrounding a passage open to a space below the ceiling and the space above the ceiling, a door located in the passage for closing the passage, bottom members joined to said walls, said bottom members extended inwardly into the passage and having top portions located in said passage, said door having an outwardly directed flange located over and engageable with the top portions of the bottom members to support the door on the bottom members, a panel in said passage above said door, said panel being engageable with said door, and insulation means in said passage located above said panel for reducing heat loss through said passage.

2. The apparatus of claim 1 including: a seal located between the flange and the top portions of the bottom members to inhibit the flow of air between the door and bottom members.

3. The apparatus of claim 1 wherein: said top portion of the bottom members have a top surface with a continuous groove, and a seal located in said groove engageable with said flange to inhibit the flow of air between the door and bottom members.

4. The apparatus of claim 3 wherein: the groove has a horizontal section and a vertical section, and said seal has a horizontal portion located in said horizontal section of the groove and a vertical portion located in the vertical section of the groove.

5. The apparatus of claim 1 wherein: said door has a bottom wall, and upright side walls surrounding a space, and an insulation member located in said space.

6. The apparatus of claim 1 wherein: the top portions of the bottom members have a continuous groove open to the passage, and a continuous seal located in the groove engageable with the flange to inhibit the flow of air between the door and bottom members.

7. The apparatus of claim 6 wherein: the groove has a horizontal section and a vertical section, and said seal has a horizontal portion located in said horizontal section of the groove and a vertical portion located in the vertical section of the groove.

8. The apparatus of claim 1 wherein: said insulation means is a block of insulation material having a size to substantially fill the passage above the panel, and means securing the insulation material to said panel.

9. The apparatus of claim 8 including: a gasket surrounding the insulation material and engageable with said upright walls of the housing to inhibit the flow of air through the passage.

10. The apparatus of claim 1 wherein: said panel is a flat sheet rock panel.

11. An apparatus for providing a closure for a ceiling opening from an inside space to an attic of a building comprising: a housing having upright walls surrounding an upright passage open to the inside space and attic of a building, said housing having a size and shape to fit in the opening in the ceiling, said side walls having bottom members extended inwardly into and surrounding the passage, said bottom members having a continuous upper inwardly directed shoulder surrounding the passage, a door located in the passage engageable with said shoulder for closing said passage, and insulation means in said passage above said door for reducing heat loss through said passage.

12. The apparatus of claim 11 including: a seal located between said shoulder and door for preventing the flow of air between the shoulder and door.

13. The apparatus of claim 11 wherein: said shoulder has a continuous groove open to said passage, and a continuous seal located in said groove engageable with said door for preventing the flow of air between the shoulder and door.

14. The apparatus of claim 13 wherein: the groove has a horizontal section and a vertical section, and said seal has a horizontal portion located in said horizontal section of the groove and a vertical portion located in the vertical section of the groove.

15. The apparatus of claim 11 wherein: said door has a flat bottom wall, upright side walls joined to the bottom wall, and an outwardly directed flange joined to the side walls, said flange being engageable with said shoulder for closing the passage.

16. The apparatus of claim 15 including: an insulation member in the space between said upright side walls of the door.

17. The apparatus of claim 15 including: a continuous seal located between the shoulder and flange to prevent the flow of air between the shoulder and flange.

18. The apparatus of claim 15 wherein: the shoulder has a top surface with a continuous groove open to the passage, and a continuous seal located in the groove engageable with the flange to inhibit the flow of air between the door and shoulder.

19. The apparatus of claim 18 wherein: the groove has a horizontal section and a vertical section, and said seal has a horizontal portion located in said horizontal section of the groove and a vertical portion located in the vertical section of the groove.

20. The apparatus of claim 15 including: a generally flat panel located above the door, said panel being engageable with said flange.

21. The apparatus of claim 20 wherein: said insulation means is a block of insulation material having a size to substantially fill the passage above the panel, and means securing the insulation material to said panel.

22. The apparatus of claim 21 including: a gasket surrounding the insulation material and engageable with said upright walls of the housing to inhibit the flow of air through the passage.

23. An apparatus for providing a closure for a ceiling opening to a space above the ceiling comprising: a housing having upright walls surrounding an upright passage open to the space above the ceiling, said housing having a size and shape to fit in the opening in the ceiling, and a door located in said passage for closing the passage, means on said walls for retaining the door is said passage, said means on said walls including bottom members extended inwardly into the passage, said door having an outwardly directed flange located over and engageable with said bottom members to support the door on the bottom members.

24. The apparatus of claim 23 including: a seal located between the flange and bottom members to inhibit the flow of air between the door and bottom members.

25. The apparatus of claim 23 wherein: said bottom members have a top surface with a continuous groove, and a seal located in said groove engageable with said flange to inhibit the flow of air between the door and bottom members.

26. The apparatus of claim 25 wherein: the groove has a horizontal section and a vertical section, and said seal has a horizontal portion located in said horizontal section of the groove and a vertical portion located in the vertical section of the groove.

27. The apparatus of claim 23 wherein: said door has a bottom wall, and upright side walls surrounding a space, and an insulation member located in said space.

28. The apparatus of claim 21 wherein: said door includes an outwardly directed flange joined to the side walls, said means on said side walls including an inwardly directed shoulder, said flange being engageable with the shoulder to support the door on the shoulder.

29. The apparatus of claim 28 wherein: the shoulder has a top surface with a continuous groove open to the passage, and a continuous seal located in the groove engageable with the flange to inhibit the flow of air between the door and shoulder.

30. The apparatus of claim 29 wherein: the groove has a horizontal section and a vertical section, and said seal has a horizontal portion located in said horizontal section of the groove and a vertical portion located in the vertical section of the groove.

* * * * *